United States Patent [19]

Russell

[11] 4,217,134

[45] Aug. 12, 1980

[54] COMPOSITIONS AND METHODS FOR DESULPHURIZING MOLTEN FERROUS METALS

[75] Inventor: Robert E. Russell, LaGrange Park, Ill.

[73] Assignee: Molten Steel Products, Inc., Chicago, Ill.

[21] Appl. No.: 48,146

[22] Filed: Jun. 13, 1979

[51] Int. Cl.[2] ..... C22B 9/10; C21C 7/02

[52] U.S. Cl. ..... 75/58; 75/53; 75/257

[58] Field of Search ..... 75/53, 58, 257

[56] References Cited

U.S. PATENT DOCUMENTS

| | | | |
|---|---|---|---|
| 3,964,200 | 6/1976 | Krupman | 75/58 |
| 3,964,899 | 6/1976 | Jones | 75/58 |
| 4,014,685 | 3/1977 | Jones | 75/58 |
| 4,039,320 | 8/1977 | Uemura | 75/58 |
| 4,137,072 | 1/1979 | Kawakami | 75/58 |

*Primary Examiner*—P. D. Rosenberg

*Attorney, Agent, or Firm*—Keil & Witherspoon

[57] ABSTRACT

Compositions comprising 50–75% w/w of lime, 20–30% w/w of fluorspar ($CaF_2$), and up to 20% w/w of ground aluminum, and methods to desulphurize molten ferrous metals, notably molten steels, by adding said compositions to molten ferrous metals in the ladle, but more preferably, by injecting the composition in particulate form into the molten body of ferrous metals, e.g., molten steels.

7 Claims, No Drawings

COMPOSITIONS AND METHODS FOR DESULPHURIZING MOLTEN FERROUS METALS

BACKGROUND

The presence of sulphur in steel has a detrimental effect on the surface quality and degree of cracking, and consequently on the degree of scarfing and grinding required and the yield achieved in the finishing process. Particularly in the fields of brittle failure, welding and fabrication, steel requirements are becoming increasingly stringent, and sulphur can play an important and sometimes dominant role through its effect on steel properties.

Thus, the ever increasing emphasis on steel quality combined with the widening use of automatic production methods compel steelmakers to reduce sulphur levels to the absolute minimum that is economically practical.

With the exception of the double slag electric arc process, ultra low sulphur steels below 0.01% cannot be produced by conventional steelmaking processes unless special attention is given to ensure that the charge materials are low in sulphur. Difficulties in achieving sulphur specifications due to the variable quality of these charge materials (and particularly steel scrap) often result in extra furnace time with the subsequent increase in steelmaking costs and reduction in productivity. The increasing commercial demand for very low sulphur steels has resulted in the adoption of means for the external desulphurization of molten iron, i.e. by means outside the blast furnace.

Several methods are already used for effecting external desulphurization which include stirring a desulphurizing agent such as calcium carbide into the metal, plunging desulphurizing agents, e.g. magnesium impregnated into coke under the surface of the molten metal and injecting particulate desulphurizing agents, e.g. lime, calcium carbide, or calcium cyanamide into the metal.

All the methods mentioned above involve the desulphurization of molten ferrous metal by treating the impure metal, in a suitable vessel, with an agent having known desulphurization properties. The vessel in question may be, for example, a transfer ladle or holding ladle, a mixer vessel in which molten iron from the blast furnace is stored before conversion into steel, or a torpedo ladle.

PRIOR ART

The prior art, as presently known, which comes closest to the subject invention is U.S. Pat. No. 4,014,684, issued Mar. 29, 1977, which discloses desulphurizing fluxes comprising lime, sodium carbonate, fluorspar, and alumina, and preferably also aluminum or an aluminum alloy. Such fluxes preferably are added to molten steel by injections of particles thereof in a carrier gas.

BRIEF DESCRIPTION OF THE INVENTION

The subject invention pertains to chemical compositions which, when added to molten ferrous metals, viz. molten iron or molten steel, reduce the sulphur content in said metals to a small fraction of the initial sulphur content.

The compositions consist essentially of finely divided particles of lime, preferably as quicklime (CaO), 50–75% w/w; of flurospar ($CaF_2$), 20–30% w/w; and of aluminum particles, up to 20% w/w.

The lime, preferably in the form of quicklime (CaO), part or all of which may have been converted to slaked lime—$Ca(OH)_2$—by atmospheric moisture, is pulverized to a particle size such that at least 50% w/w will pass through a 200 mesh standardized screen. There is no preferred or critical minimum size for the quicklime, the fluorspar, or the aluminum. The maximum paticle sizes are:

Lime—At least 93% passes through a 100 mesh standard screen and at least 80% passes through a 200 mesh standardized screen, e.g., a Tyler standard screen.

Fluorspar—Same as Lime.

Aluminum—at least 90% passes through a screen of −16 mesh.

There is no minimum limit for the particle sizes of any component.

The foregoing compositions are added to molten steel in quantities in the range of about 8 lbs./ton up to about 20 lbs./ton of steel.

Preferred embodiments of my desulphurizing compositions are described in the following examples, wherein percentages are by weight.

EXAMPLE 1

70% Pulverized Quicklime
25% Fluorspar Ceramic #1
5% Ground Aluminum

Particle sizes of the components in the above examples are:

Lime, fluorspar—93% passes through 100 mesh screen and 80% passes through 200 mesh screen. Aluminum—90% is −16 mesh or smaller.

It is preferred that the compositions consist essentially of 50–75% of pulverized quicklime, 20–30% of fluorspar and 3–20% of ground aluminum. The compositions containing aluminum particles provide an advantage of upgrading the steel being produced.

The foregoing compositions provide an advantage by omitting the use of the highly alkaline sodium carbonate used in the flux compositions of the aforesaid U.S. patent.

I claim:

1. A composition useful in the desulphurization of molten steel consisting essentially of 50–75% of pulverized lime, 20–30% of finely divided fluorspar, and 3–20% of finely divided aluminum particles, said percentages being by weight.

2. A composition as claimed in claim 1 wherein said lime is quicklime.

3. A composition as claimed in claim 2 wherein said composition consists essentially of said quicklime, said finely divided fluorspar and said finely divided aluminum particles in the stated percentages by weight.

4. A composition as claimed in claim 1 wherein said composition consists essentially of quicklime as said pulverized lime, said finely divided fluorspar and said finely divided aluminum particles in the stated percentages by weight.

5. A process for desulphurizing a molten ferrous metal, which comprises adding to said molten ferrous metal a composition as claimed in claim 1.

6. A process as claimed in claim 5 wherein said metal is steel.

7. A process of desulphurizing a molten steel, which comprises adding to said molten steel a composition as claimed in claim 1, in an amount of said composition in the range of about 8 lbs. per ton of steel to about 20 lbs. per ton of steel.

* * * * *